United States Patent [19]

Chakerian

[11] 4,157,620

[45] Jun. 12, 1979

[54] METHOD OF PRODUCING BLEACHED, DRIED FRUIT

[76] Inventor: Jonathan P. Chakerian, 269 W. Sycamore, Reedley, Calif. 93654

[21] Appl. No.: 895,253

[22] Filed: Apr. 10, 1978

[51] Int. Cl.[2] ..... F26B 7/00

[52] U.S. Cl. ..... 34/12; 34/4; 34/93; 426/259

[58] Field of Search ..... 34/4, 60, 12, 93; 426/259, 253

[56] References Cited

U.S. PATENT DOCUMENTS

| | | | |
|---|---|---|---|
| 401,109 | 4/1889 | Baker | 426/259 |
| 1,218,156 | 3/1917 | Andersen | 34/93 X |
| 1,504,108 | 8/1924 | Elspass | 426/259 X |
| 1,556,865 | 10/1925 | Muller | 34/93 X |
| 2,648,605 | 8/1953 | Aliotti | 426/259 |
| 4,069,593 | 1/1978 | Huang | 34/93 |

*Primary Examiner*—John J. Camby

*Attorney, Agent, or Firm*—Huebner & Worrel

[57] ABSTRACT

A method of producing bleached dried fruit particularly bleached raisins, in which the fruit is supported in a porous layer upwardly spaced from the ground, the layer is overlaid with a film of plastic material which filters out visible light rays while transmitting infra red light rays, sulfur dioxide is passed upwardly through the layer, and the layer is exposed to sun light filtered by passage through the film to dry the fruit while overlaid with the sheet material.

9 Claims, 1 Drawing Figure

METHOD OF PRODUCING BLEACHED, DRIED FRUIT

BACKGROUND OF THE INVENTION

1. Field of the Invention:

The present invention relates to a method of producing a bleached, dried fruit, and more particularly to such a method for use in the field in which fruit is subjected to the products of combustion from burning sulfur and subsequently dried by solar radiation having the visible light rays filtered therefrom.

2. Description of the Prior Art:

It has, of course, long been known to dry fruit by solar radiation, as in the production of raisins from grapes. Such sun dried raisins are produced in a well-known manner simply by disposing bunches of freshly picked grapes on paper trays placed on the ground in the vineyards between rows of grapevines. While so disposed, the grapes are dried by exposure to the rays of the sun without the application of additional heat. However, raisins so produced by this process are dark in color, being substantially black, even though the grapes are light greenish or yellowish in color, as picked. While such raisins are popular, there exists a large and well recognized demand for bleached or golden raisins.

Such bleached raisins are relatively expensive because of the additional labor, equipment, and energy required in their production as compared with the sun drying of grapes to produce dark raisins. Also, the relative complexity of the conventional process for producing bleached raisins and the amount of capital required to purchase the equipment needed makes it essentially a plant operation. In fact, insofar as the applicant is aware, bleached raisins had never been produced in the fields or vineyards prior to the present invention. Thus, the conventional process requires the grapes to be picked and transported to a properly equipped plant. At such a location, the grapes are first immersed in a tank containing an aqueous sodium hydroxide solution minutely to crack the skins. The grapes are then washed repeatedly to remove all traces of sodium hydroxide. The grapes are then placed in a "sulfur house" which is a substantially air-tight room in which sulfur is burned. The grapes are subjected to sulfur dioxide fumes from the burning sulfur for a period of time. The grapes are then dried artificially into raisins in a dehydrator which, typically, is heated by fossil fuel. Prior to the present invention, it was considered necessary to perform such drying artificially since exposure to solar radiation of the grapes which have previously been subjected to the sodium hydroxide solution and then sulfur dioxide causes such grapes to darken resulting in unbleached raisins.

As can be seen, this previously known process for producing bleached raisins requires that the grapes be handled many more times than in the production of ordinary, dark raisins. The conventional bleaching process requires a dehydrator, which is relatively expensive as is the fuel required for its operation. A sulfur house must be provided at additional expense.

As will subsequently become apparent the process of the present invention for the first time permits the field production of bleached raisins, minimizes handling and labor, requires no immersing tanks of sodium hydroxide, requires no rinsing to cleanse the grapes of sodium hydroxide before drying, requires no sulfur houses, and requires no fuels for dehydration.

PRIOR ART STATEMENT

Pursuant to 37 C.F.R. 1.97 and 1.98 the applicant is not aware of any more relevant prior art than that discussed above or that disclosed in his copending patent application Ser. No. 818,143, filed July 22, 1977 entitled "Field Drying Device For Raisins and Other Fruits" of which he encloses copies of the drawings for the Examiner's convenience.

SUMMARY OF THE INVENTION

Accordingly, it is an object of the present invention to provide an improved method for the production of a bleached, dried fruit.

Another object is to provide such a method which can be performed in the field.

Another object is to provide such a method which produces such bleached fruit by solar energy.

Another object is to provide such a method which minimizes handling of fruit being processed.

Another object is to provide such a method which can be carried out with relatively inexpensive equipment.

Another object is to produce bleached raisins in the vineyards in which their grapes are grown.

Another object is to provide such a method which minimizes product contamination and losses to insects and rodents.

Still another object is to provide such a method in which fruits bring processed are not subjected to potentially harmful chemicals.

Further objects are to provide a method for producing bleached raisins and other bleached dried fruit which is economical, dependable, and fully effective in accomplishing its intended purpose.

DESCRIPTION OF THE PREFERRED EMBODIMENT

Figure 1:
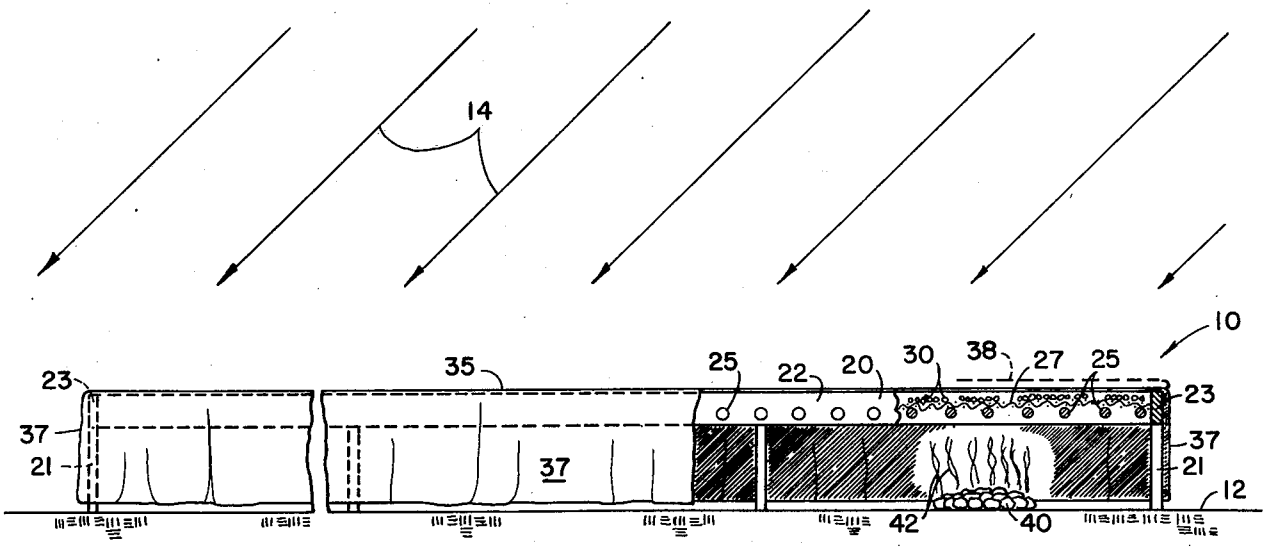
FIG. 1 is a side elevation of an apparatus useful for carrying out the method of the present invention with portions broken away to show certain internal structure as well as fruit being processed.

Referring with greater particularity to the drawing, in FIG. 1 is shown an illustrative apparatus, indicated generally by the numeral 10, for carrying out the method of the present invention. Obviously, any other suitable apparatus can be employed. The apparatus preferably is disposed in a vineyard between rows of grapevines, not shown, where the apparatus is supported on the ground 12 and is subjected to solar radiation, as indicated by the arrows 14. Additional details of the apparatus and its mode of operation are given in the applicant's copending United States Patent Application, designated above.

The apparatus includes an elongated rectangular frame 20 supported in upwardly spaced relation to the ground 12 by legs 21. The frame, preferably, is extended longitudinally between rows of grapevines, not shown, and has a pair of longitudinally extending sides 22 connected at their opposite ends by a pair of transversely extending ends 23. The sides and ends are approximately three inches deep. The frame is provided with a plurality of transversely extending, longitudinally spaced bars 25 interconnecting the longitudinal sides between the transverse ends. The bars are supported in any convenient manner at their opposite ends which engage the longitudinal sides. The bars lie in a substantially horizontal common plane which is disposed substantially below the vertical centerline of the sides. A length of perforated material 27 extends within the frame. The material is rested on and supported by the bars 25 and is substantially coextensive with the frame inwardly of the sides thereof. The material, preferably, is hardware cloth of metal or plastic having one-fourth inch mesh.

The apparatus 10 is depicted in the drawing with grapes 30 rested on the perforated material 27 for processing. While the method of the present invention is particularly adapted to the production of bleached raisins from grapes, other fruits, such as pears, plums, peaches, or nectarines can be bleached and dried by the method of the present invention, if desired. The grapes are disposed in a porous or permeable layer or mass which is supported in upwardly spaced relation to the ground 12.

The grapes 30 are overlaid with a film 35 of black vinyl plastic or the like which screens out the visible light rays put passes infra red light rays. It has been discovered that it is the visible light rays which causes darkening of the grapes when they are dried by exposure to solar radiation. Films of other plastic materials such as polyvinyl chloride, polyvinyl-chloride-acetate, polystyrene, cellulose acetate, ethyl cellulose, and polyethylene are suitable for carrying out the method of the present invention if black to screen out visible light rays and capable of passing infra red light rays. The film is also preferably minutely perforate to pass water vapor therethrough but sufficiently minutely perforate to serve as an impediment to the passage of sulfur dioxide although not necessarily precluding such passage. The perforations should be microscopic or barely macroscopic. Expressed differently, the perforations should be large enough to pass water vapor but small enough to constitute a barrier to rain water and like condensed water. The film preferably has a length and width substantially greater than the corresponding dimensions of the frame 20 so that the material when positioned to cover the grapes 30, drapes downwardly of the frame along the sides 22 and ends 23 as pendant flaps 37 and 38 respectively. The film should extend downwardly from said sides to positions below the lowermost grapes 30 but need not extend to positions closely adjacent to the ground 12. As will subsequently be appreciated, the shorter the draped portions of the film, the more sulfur dioxide escapes. The longer the draped portions of the film, the less is the subsequent air circulation for drying purposes. Downward extension of from one-fourth to seven-eighths the distance from the frame to the ground is usually an appropriate compromise. The flaps can be turned up adjacent to the sides and extended reversely therefrom to overlay the central portion of the sheet of material above the frame 20, as indicated by the dashed line 38. These different dispositions of the flaps are advantageous at different steps of the method of the present invention as subsequently will be described. Relatively thin flexible material known to the plastics trade as "film" facilitates the carrying out of the method of the present invention. However, thicker, relatively rigid plastic material known to the plastics trade as "sheet" can also be employed, as can any other material which screens out the visible light rays while admitting the infra red rays of the solar radiation.

During certain steps of the method of the present invention, sulfur, indicated by the numeral 40, is burned on the ground below the sheet material 35. The products of combustion, consisting predominantly of the sulfur dioxide gas pass upwardly, as indicated by the numeral 42, through the perforated material 27 and the layer of grapes 30.

The method of the present invention as practiced for the production of bleached raisins can be employed in a vineyard without requiring the transport of the grapes to a plant for so doing.

The frame 20 of the apparatus 10 is positioned in a vineyard between rows of grapevines, and the perforated material 27 is supported therein as previously described. Bunches of grapes 30 are picked from the vines and immediately laid upon the perforated material to form a porous, air permeable, layer of grapes supported in upwardly spaced relation to the ground.

The film 35 is then draped over the frame 20 and arranged to overlay the layer of grapes with the flaps 37 and 38 of the material extending downwardly about the frame toward the ground.

Sulfur 40 is placed beneath the layer of grapes 30, as in a shallow depression in the ground, and ignited in any convenient manner releasing products of combustion 42 which pass through the layer subjecting the grapes to the action of the sulfur dioxide in the products of combustion. As a result of the heat of combustion, the warm sulfur dioxide rises and passes through the layer of grapes. As it cools, it passes downwardly through the layer. The concentration of sulfur dioxide about the layer is increased by the downwardly draped disposition of the flaps 37 and 38 which, being substantially impervious to the passage of sulfur dioxide, restrains the escape thereof. Thus, the sulfur dioxide needed is minimized. The burning of the sulfur and consequent exposure of the grapes to sulfur dioxide is continued until the sulfur dioxide penetrates through the grapes. It has been found that when a frame 20 having dimensions of substantially twelve feet longitudinally and three feet transversely is utilized with approximately two hundred twenty pounds of grapes supported thereon, the combustion of approximately three pounds of sulfur beneath the frame gives satisfactory results. About three hours are required for combustion of the sulfur under these circumstances. A plurality of such frames can be employed in a vineyard as described in the previously mentioned United States Patent Application, Ser. No. 818,143, and the steps including picking the grapes and combustion of sulfur can be carried out simultaneously in different portions of a vineyard to reduce the number of workers required.

Having performed its first function of temporarily confining the sulfur dioxide, the film 35 remains in place in covering relation to the layer of grapes 30 while day after day the film is exposed to solar radiation and the grapes exposed to solar radiation with the visible light rays filtered out by the film. As a result, the grapes are warmed and water vapor is released to pass upwardly through the film. It is vital to the bleaching of raisins that the film filter out the visible light rays. If, for example, the film of clear plastic is utilized in place of the black plastic, the raisins promptly turn dark and cannot be bleached.

The flaps 37 and 38 of the sheet 35 under certain circumstances can advantageously be folded back upon the portion of the sheet above the frame, as indicated by the dashed lines for the flap 38 at the right of the drawing permitting improved circulation of air about the frame and through the layer of grapes.

The frame 20, the layer of grapes 30 supported thereby, and the film 35 of material overlaying the layer are then left in the vineyard for exposure to the rays of the sun. The heat produced by these rays dries the grapes, forming raisins. While the raisins are being formed, the film, as previously described, screens out the visible light rays of the solar radiation which would otherwise darken the drying grapes so that bleached raisins result. In fact, if precisely the same process is followed but the grapes covered with clear plastic rather than black plastic, the usual dark raisins are produced with no discernible bleaching.

Bleached raisins produced by the method of the present invention practiced as described are similar in appearance to bleached raisins produced by the previously described prior art process but not identical. Raisins produced by the present method are lighter in color than the grapes from which they are made, frequently are lighter in color than conventionally bleached raisins, and sometimes are slightly translucent. The method of the present invention is advantageous in that a greater weight of bleached raisins are produced from an initial quantity of grapes than is the case with the prior art process. The method of the present invention typically requires 2.36 pounds of grapes to produce a pound of bleached raisins while the prior art process typically requires 3.00 pounds of grapes to produce a pound of bleached raisins. The production of a pound of raisins from three pounds of grapes have heretofore been regarded as excellent.

The method of the present invention also produces relatively large yield because losses due to insects, rodents, and other organisms are minimized. First, the grapes are exposed to sulfur dioxide shortly after picking and any insects and other organisms present at picking are killed immediately. Second, since all of the steps can be performed in the field and the grapes do not have to be stored between the steps, the opportunity for insects and rodents to consume or contaminate the partially processed grapes is greatly reduced. Third, losses due to excessive handling are avoided. Further, grapes dry somewhat more evenly and rapidly when covered by the described black film than when fully exposed to solar radiation. It captures heat so as to facilitate drying of the grapes. It permits water vapor to escape but excludes rain water. If clear plastic is used to cover the grapes, more heat reaches the layer of raisins 30 and they dry even more rapidly but they do not bleach.

Although the invention has been shown and described in what is conceived to be the most practical and preferred method, it is recognized that departures may be made therefrom within the scope of the invention, which is not to be limited to the illustrative details disclosed.

Having described my invention, what I claim as new and desire to secure by Letters Patent is:

1. A method of producing bleached dried fruit comprising:

A. supporting the fruit in a porous mass,

B. passing sulfur dioxide through the mass,

C. covering the mass with a film material which filters out visible light rays, and D. drying the mass by exposure to solar radiation filtered by passage through the film.

2. The method of claim 1 in which the mass is supported in a permeable layer by a perforated element in upwardly spaced relation to the ground.

3. The method of claim 2 in which the film is minutely perforate to pass water vapor but the perforations are small enough to exclude rain water and the like.

4. The method of claim 3 in which the film is a flexible, black plastic.

5. A method of producing bleached raisins in the field comprising:

A. supporting grapes in a porous layer in upwardly spaced relation to the ground, B. passing sulfur dioxide through the layer, C. overlaying the layer with a film of plastic material which screens out the visible light rays, and D. exposing the grapes to sun light passed through the film until the grapes are converted to raisins while continuing to screen out the visible light rays.

6. The method of claim 5 in which the sulfur dioxide is formed and passed through the layer by burning sulfur beneath the layer.

7. The method of claim 5 in which the film is positioned in overlaying relation to the layer in advance of passing sulfur dioxide through the layer partially to confine the sulfur dioxide to the layer.

8. The method of claim 5 in which the film is of black vinyl material.

9. A method of producing bleached raisins in the field comprising supporting grapes in the field in a layer in upwardly spaced relation to the ground for the circulation of air therethrough, overlaying the grapes with a film of black plastic material which screens out visible light rays, admits infra red rays and is impervious to the passage of sulfur dioxide, burning sulfur and passing the products of combustion through the layer of grapes while overlaid with said film, and drying the grapes in the field while overlaid with said film.

* * * * *